US006843695B1

(12) United States Patent
Jackson et al.

(10) Patent No.: US 6,843,695 B1
(45) Date of Patent: Jan. 18, 2005

(54) WATER WALKER ASSISTANT FOR PHYSICALLY CHALLENGED AND REHABILITATION PATIENTS

(76) Inventors: Barbara B. Jackson, 1018 Ann Ave., The Villages, FL (US) 32159-2400; Raymond W. Jackson, 1018 Ann Ave., The Villages, FL (US) 32159-2400

( * ) Notice: Subject to any disclaimer, the term of this patent is extended or adjusted under 35 U.S.C. 154(b) by 0 days.

(21) Appl. No.: 10/644,928

(22) Filed: Aug. 21, 2003

(51) Int. Cl.[7] ..... B63B 35/74
(52) U.S. Cl. ..... 441/129
(58) Field of Search ..... 441/129, 130, 441/131, 35, 44, 45; 472/128, 129

(56) References Cited

U.S. PATENT DOCUMENTS

| | | | | |
|---|---|---|---|---|
| 2,051,281 A | | 8/1936 | Webber | |
| 2,562,080 A | | 7/1951 | Barnes | |
| 2,946,068 A | | 7/1960 | Jasper | |
| 3,161,897 A | | 12/1964 | Hill | |
| 4,358,866 A | * | 11/1982 | Rhodes | 114/363 |
| 4,580,988 A | | 4/1986 | Correll | |
| 4,815,761 A | * | 3/1989 | Henderson et al. | 280/47.3 |
| 4,840,591 A | | 6/1989 | Dulin et al. | |
| 4,966,397 A | * | 10/1990 | McKinnon | 285/197 |
| 4,993,980 A | | 2/1991 | Dulin et al. | |
| 5,152,706 A | | 10/1992 | Fister | |
| 5,348,505 A | | 9/1994 | Rothhammer | |
| 5,465,676 A | * | 11/1995 | Falcaro | 114/222 |
| 5,667,416 A | | 9/1997 | Barth | |
| 5,971,823 A | | 10/1999 | Sanso | |
| 6,394,868 B1 | | 5/2002 | Katz | |

* cited by examiner

*Primary Examiner*—Sherman Basinger
(74) *Attorney, Agent, or Firm*—Richard C. Litman

(57) ABSTRACT

The water walker assistant is a rectangular shaped buoyant frame with handles for assisting physically challenged individuals walk or float in water. The frame is made of interconnected elongated buoyant members, such as PVC tubing, which are fitted with sections of buoyant foam. The interconnected members define front, rear and side sections of the frame, and the front section is optionally a removable crossbar. The user enters the device by either removing the crossbar or placing the device over his/her body. The water walker assistant features two handles with hand-grips, and cushioned side sections to support the user's forearms inside the device. Elongated members with foam fittings extend from the rear and front of the invention, adding stability to the device, while providing shock absorption in the event of contact with obstacles.

19 Claims, 7 Drawing Sheets

WATER WALKER ASSISTANT FOR PHYSICALLY CHALLENGED AND REHABILITATION PATIENTS

BACKGROUND OF THE INVENTION

1. Field of the Invention

The present invention relates to a flotation device, and particularly a buoyant walking assistant for use in the water that prevents the user from tipping to either side and supports the user while walking in water.

2. Description of the Related Art

Individuals with physical disabilities often struggle to gain improved mobility through long periods of physical therapy. Physical therapy may consist of electrical stimulation, message, physical exercise and other more exotic forms of treatment. The therapy is generally designed to improve muscle strength or simply prevent muscle decay for lack of use. Patients in physical therapy, however, also risk aggravating an existing condition or suffering new injury due to accidents.

One form of therapy that many consider safe and effective is aqua therapy. Aqua therapy offers people with disabilities more options in terms of physical movement and is arguably less stressful on the body. However, patients in aqua therapy also face the very real danger of drowning or other water related trauma. Consequently, various flotation devices have been developed for physically challenged or physically limited individuals in order to facilitate movement in the water, while protecting their safety.

U.S. Pat. No. 2,051,281, issued Aug. 18, 1936 to Webber, describes a float for a child having a circular tube and a chair disposed centrally thereto. A ring-like top or flat circular member, comprising a set of inter-connected arcuate members, engages the top of the tubular member to prevent the tube from bellying up. A chair or saddle-like member is disposed centrally of the floats and located in a plane well below these floats to prevent the device from tipping over. A plurality of L-shaped metal strap-like members secures the saddle member in place.

U.S. Pat. No. 2,562,080, issued Jul. 24, 1951 to Barnes, describes a buoyant sustaining seat which consists of a circular tube with a cross web forming a saddle or body support with openings for receiving the legs of the user and with spaces at each side of the web to provide access to the water. A lanyard or rope is disposed along the top of the tube.

U.S. Pat. No. 2,946,068, issued Jul. 26, 1960 to Jasper, shows a water float having a frame, a seat carried by the frame, and a plurality of buoyant means. The buoyant means are mounted at the four corners of the float to keep the occupant floating at a desired height in the water. The seat is positioned in the space formed in the center of the float and is preferably a sling type seat with openings to accommodate the occupant's legs.

U.S. Pat. No. 3,161,897 issued Dec. 22, 1964 to Hill, describes a float for babies or young children. The float comprises a combination of two pontoons separated by a frame. A seat is located on the frame to support a child seated therein. The use of pontoons is designed to prevent any lateral tipping of the structure.

U.S. Pat. No. 4,580,988 issued Apr. 8, 1986 to Correll, describes a flotation device adapted for physical therapy and recreation. The floatation device includes a seat for supporting the user, as well as first and second buoyant elongate body supports. The elongate body supports are each secured by a hinge to opposite ends of the seat. The body supports are positioned on opposite sides of the torso of the user and are freely and independently moveable about their respective hinges. Auxiliary stabilizing floats may be incorporated into the body supports to provide greater resistance to tipping.

U.S. Pat. Nos. 4,840,591 and 4,993,980, issued Jun. 20, 1989 and Feb. 19, 1991 respectively, to Dulin et al., show an exercise device for use in water. The device comprises a flotation jacket, which enables an exerciser to float in an upright position, while exercising and without contact with the bottom or sides of the enclosure holding the water. Flotation materials are inserted into pockets sewn into the jacket, which are positioned in such a way as to provide equal buoyant forces at the front, back and sides of the exerciser. The flotation device may also be used in conjunction with a harness supported by cables in a tank filled with water.

U.S. Pat. No. 5,152,706, issued Oct. 6, 1992 to Fister, describes a flotation suit for physically disabled persons. The suit includes a jacket, pants, and outrigger flotation members. The outriggers prevent the wearer from tilting or rotating and provide assistance with flotation. Selectively affixing the long and short outriggers to the jacket and/or the pants controls the degree and location of buoyancy. A collar flotation member is attachable to the jacket to stabilize the wearer's head and neck.

U.S. Pat. No. 5,348,505, issued Sep. 20, 1994 to Rothhammer, describes a water exercise device which increases buoyancy of a person exercising in water. The device includes a waist-encircling band of flexible buoyant material, with a flexible inextensible belt that is strapped around the user's waist. The buoyant band extends circumferentially behind the wearer, and tends to raise the wearer to a vertical position in the water.

U.S. Pat. No. 5,667,416 issued Sep. 16, 1997 to Barth, shows a flotation device for safely supporting a person, including paralyzed, disabled, or mobility impaired persons, in the water. The device includes a seat assembly surrounded by concentric outer flotation members. The outer flotation members provide the buoyancy and stability required for use. A person seated in the device may float, walk or wade in the water. A hand rest may optionally be positioned between the outer flotation members and seat assembly of the flotation device.

U.S. Pat. No. 5,971,823 issued Oct. 26, 1999 to Sanso, describes a personal flotation device with hand-held tool. The device is a flexible, cylindrical, noodle-type flotation device that is fitted with a hand-held tool head assembly. The hand-held tool may be a trigger actuated, plunger type hand pump for pumping water, or alternatively, a scrubbing brush.

U.S. Pat. No. 6,394,868 B1, issued May 28, 2002 to Katz, shows a flotation device for a child having a buoyant board and a child opening in the middle of the board. A child seat is provided beneath the opening in the board. An awning with vertical supports is mounted on the board. The awning is rotatably mounted on the awning support for movement between an operative position where the awning is over the child and an inoperative position allowing access to the child opening.

None of the above inventions and patents, taken either singly or in combination, is seen to describe the instant invention as claimed. Thus a water walker assistant for physically challenged and rehabilitation patients solving the aforementioned problems is desired.

SUMMARY OF THE INVENTION

The water walker assistant is a rectangular flotation device designed to assist physically challenged individuals ambulate in the water. In a preferred embodiment, the water walker assistant is made of interconnected PVC tubes and buoyant foam sections. The interconnected PVC tubes form a rectangular frame with two terminal PVC ends in the front and a single PVC member extending from the back. The PVC tubes are fitted with cylindrical sections of buoyant foam to increase the buoyancy of the device. The foam sections also provide cushioning for the user, as well as shock absorption in the event of collision with obstacles.

In addition, the water walker assistant features handles with cushioned grips that extend vertically from the opposing side sections. The handles help the user stay balanced while maintaining control of the device in the water. The device is optionally equipped with a removable crossbar to allow easy access to the center of the device. Alternatively, the crossbar may be stationary, in which case the user must place the device over their body. Once the user is inside the device, the device functions similar to a conventional walker in that it supports the user's weight and provides stability as the user ambulates in the water. The unique configuration of the device also prevents a user from tipping over.

The water walker assistant accommodates people of any size and shape. Different sized devices may be constructed to suit people of different dimensions, including both children and adults. In addition, the buoyant force of the device is capable of fully supporting individuals having significant weight.

Accordingly, it is a principal object of the invention to provide a flotation device for supporting a person in a body of water.

It is another object of the invention to provide a flotation device that facilitates walking in water and prevents the user from tipping over to either side.

It is a further object of the invention to provide a flotation device that accommodates people of various dimensions, including both adults and children.

It is a further object of the invention to provide a flotation device that enables a person to maintain their balance while walking in water.

Still another object of the invention is to provide a flotation device that is capable of fully supporting individuals of any weight.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to flotation devices and more specifically to a support device for assisting individuals with walking or moving in water, adapted to allow a person to maintain their balance while walking in a body of water.

Figure 1:
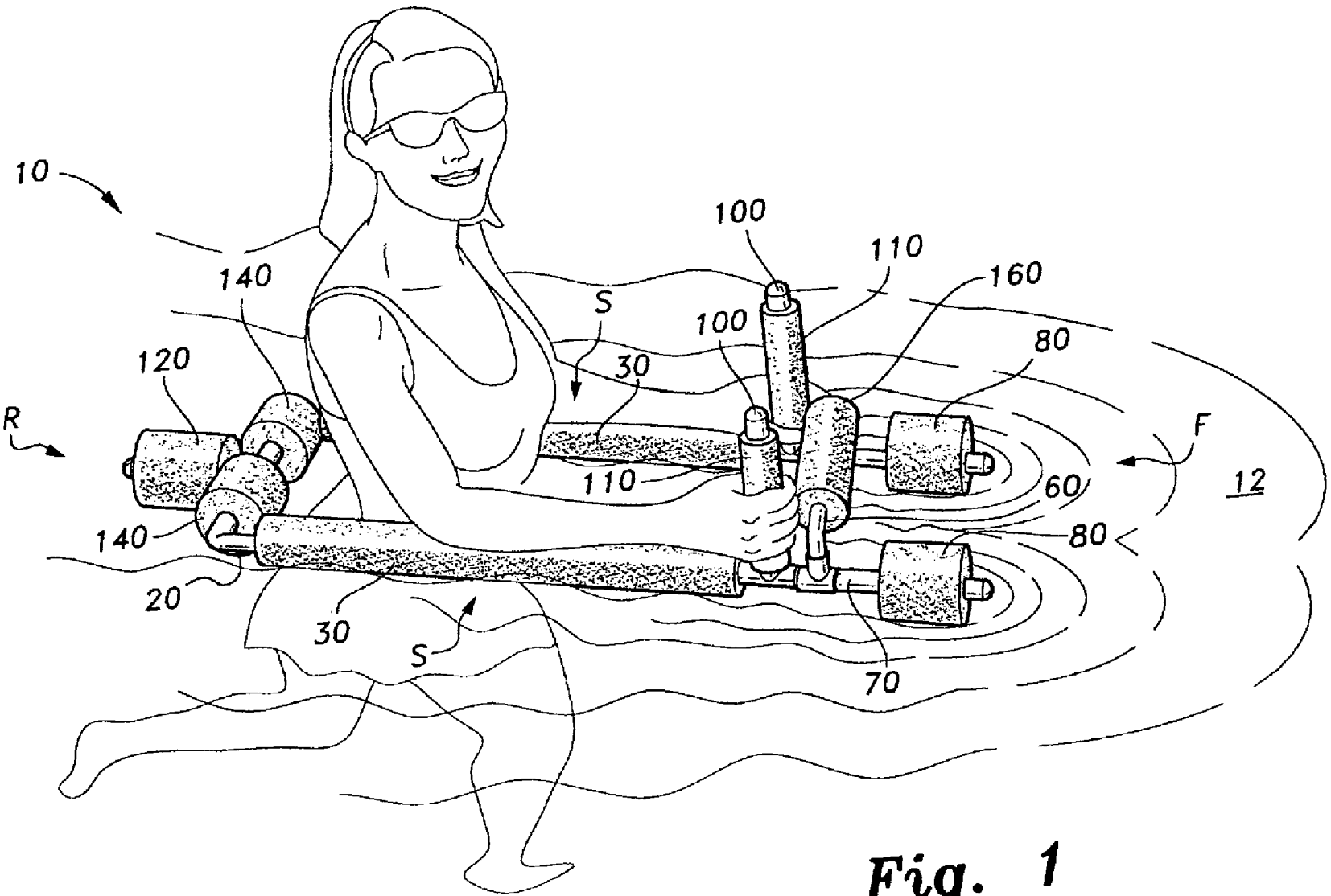
FIG. 1 is an environmental, perspective view of a person using the water walker assistant in the water.

FIG. 1 shows an environmental, perspective view of a flotation device 10 according to the invention, which is shown in use in a pool of water 12. The flotation device 10 is adapted to enable a user to walk in a body of water with minimum effort and without danger of tipping over. Broadly, the flotation device 10 comprises a rectangular buoyant frame that forms an enclosure around a user. Front F, rear R and opposing side sections S define the enclosure. Handles 100 with cushioned grips 110 extend from the forward section of the opposing side sections S and a crossbar 60 connects the two opposing side sections, forward of the handles 100. The crossbar member 60 forms the front section of the enclosure and is fitted with a cylindrical flotation member 160.

Figure 2:
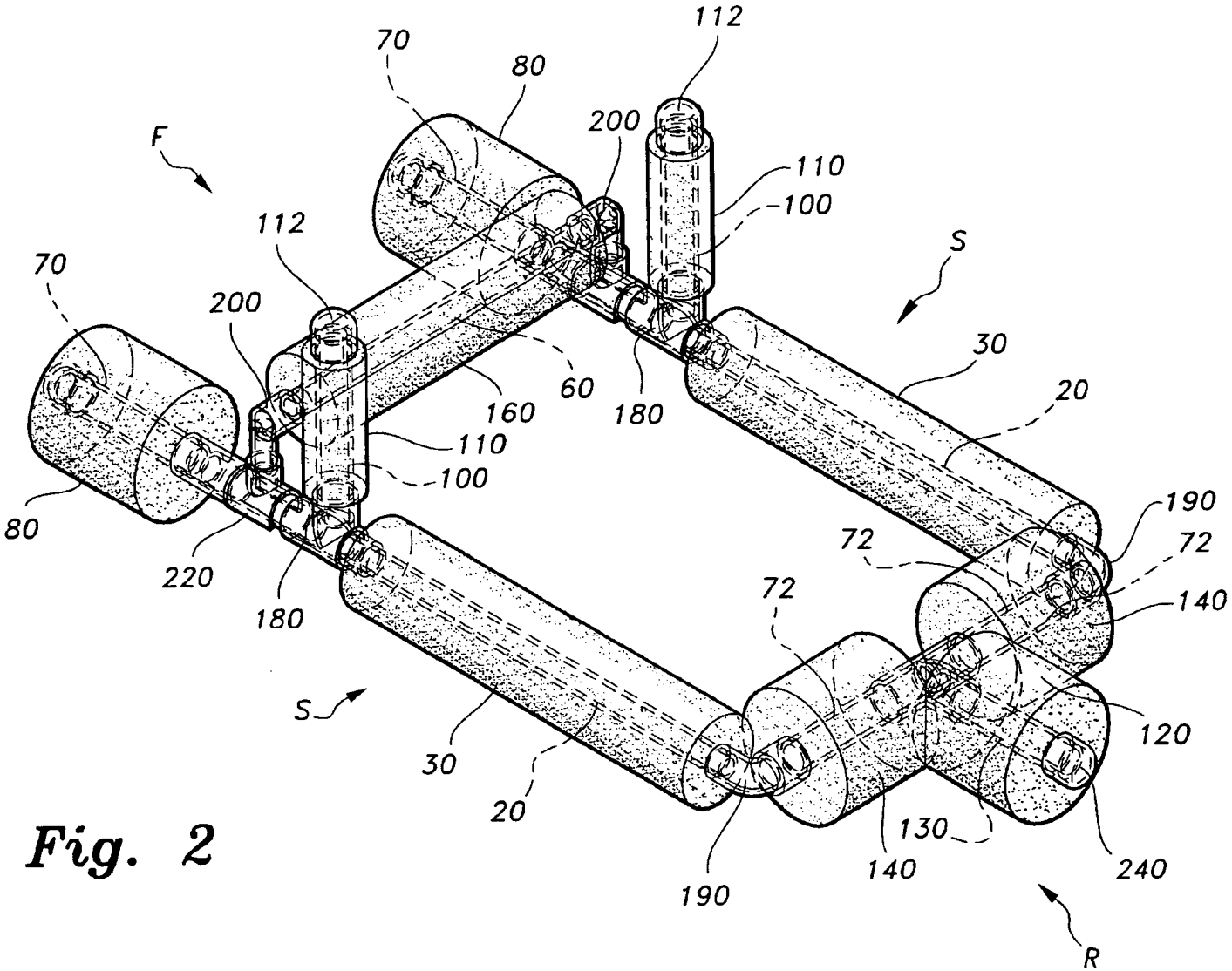
FIG. 2 is a perspective view of the water walker assistant according to the present invention.

Referring to FIGS. 1 and 2, the flotation device 10 is constructed from interconnected elongated buoyant members, defining a front F, a rear R and opposing side sections S. Each of the elongated buoyant members is fitted with cylindrical flotation members, each having a bore adapted to receive an elongated buoyant member. The flotation members add buoyancy to the device and provide cushioning as well as shock absorption. The flotation members may be made from any suitable floating material such as plastic closed cell foam, polyvinyl chloride (PVC), polyethylene (PE), neoprene, polyurethane, urethane closed cell foam (UL 1191), or the like.

As shown in FIG. 2, the rear section R of the device is connected to the opposing side sections S by way of elbow joints 190. A single elongated buoyant member 130 extends perpendicularly from the rear section R and generally planar to the frame. A cylindrical flotation member 120 is fitted over the rear-extending member 130, and two flotation members 140 are fitted on opposite sides of the rear section R.

As shown in FIGS. 1 and 2, the device features a pair of rigidly secured handles 100, which extend vertically from each of the opposing side sections S. Each handle is wrapped in a cushioned gripping material 110, which may be of the same material as the flotation members. As seen in FIG. 2, the handles 100 are connected towards the front of the opposing side sections S by way of a T-joint member 180.

Figure 3:
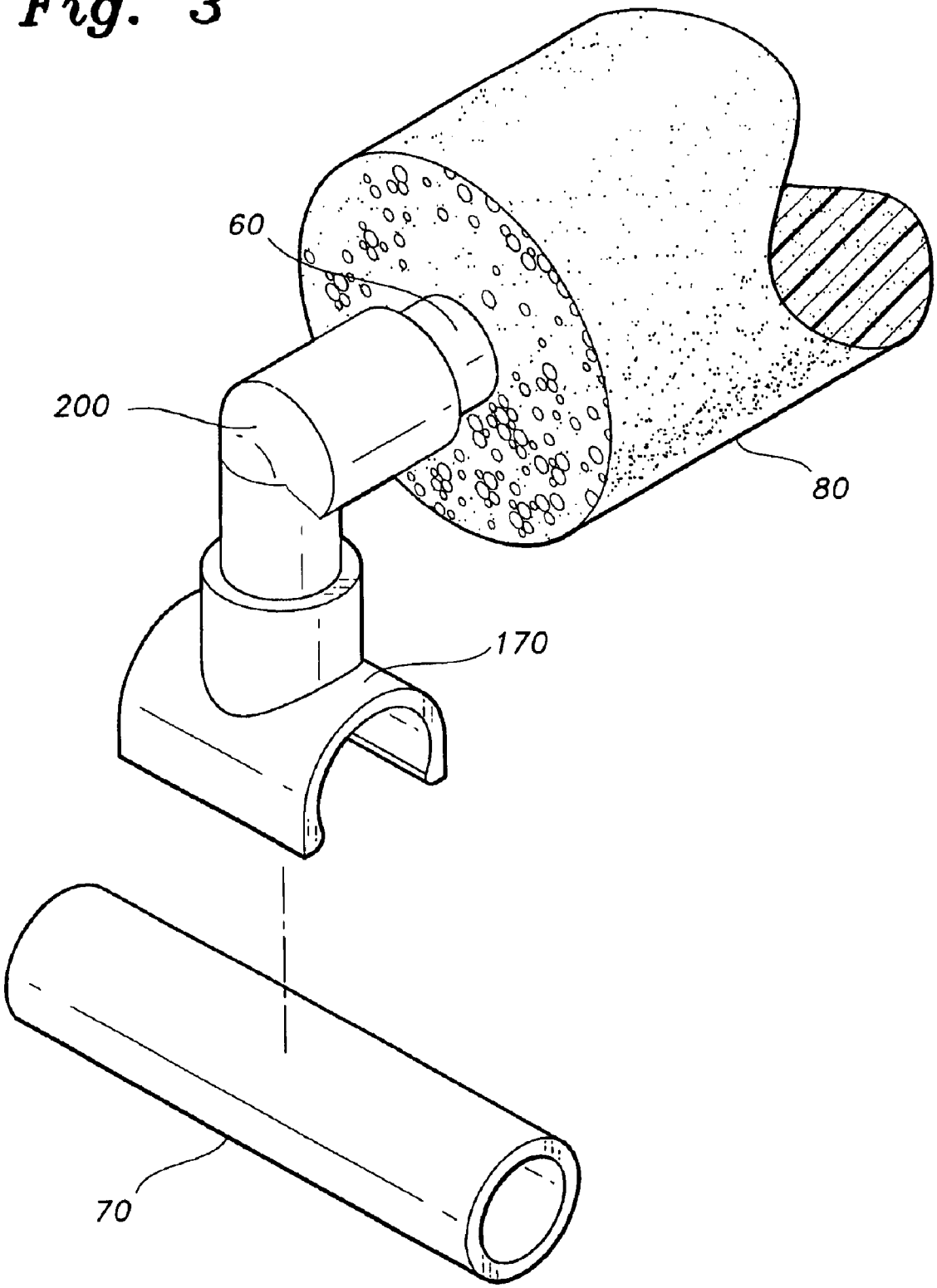
FIG. 3 is a fragmentary, detail view of the embodiment shown in FIG. 2, showing the connection between a saddle fitting attached to the crossbar and a PVC tube.
Figure 6:
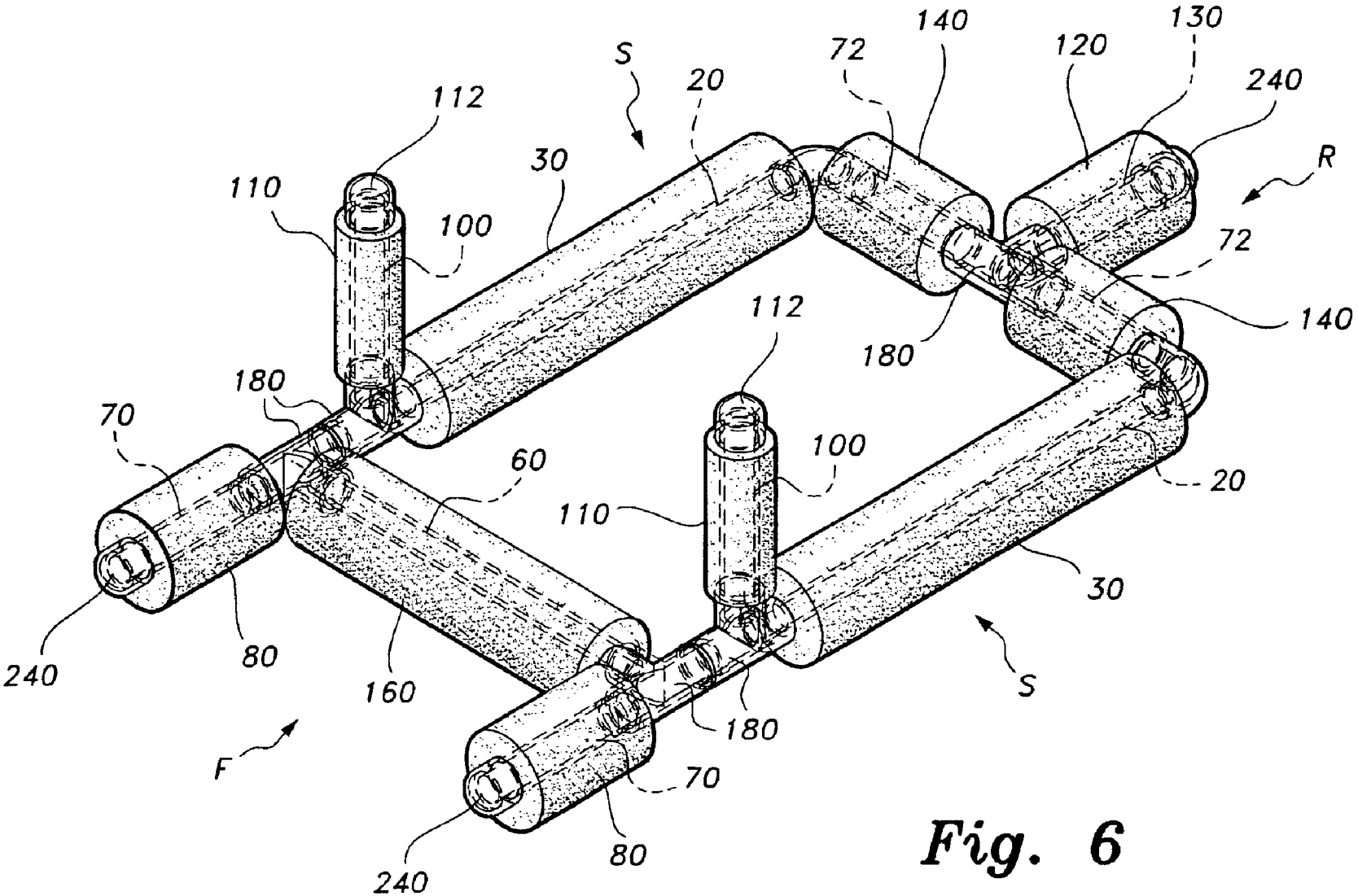
FIG. 6 is perspective view of a second embodiment of the water walker assistant with a stationary front bar.

In a preferred embodiment, the front section of the invention is defined by a removable crossbar 60 connected to the opposing side sections S, just forward of the handles 100 and behind the terminal ends of the opposing side sections 70. As shown in FIGS. 2 and 3, saddle fittings 170 attached to elbow fittings 200 connect the crossbar 60 to the opposing side sections S. In another embodiment shown in FIG. 6, the crossbar is rigidly secured to the opposing side sections S by way of T-joints 180 connecting opposite ends of the crossbar member to the opposing side sections S. In both embodiments, the crossbar 60 is fitted with a cylindrical flotation member 160.

The terminal ends 70 of the opposing side members S extend beyond the crossbar member 60. Each of the terminal ends 70 is fitted with a cylindrical flotation member 80, which provides added buoyancy and stability to the flotation device. In addition, a watertight cap 240 fits securely over the end of each terminal end 70.

Figure 5A:
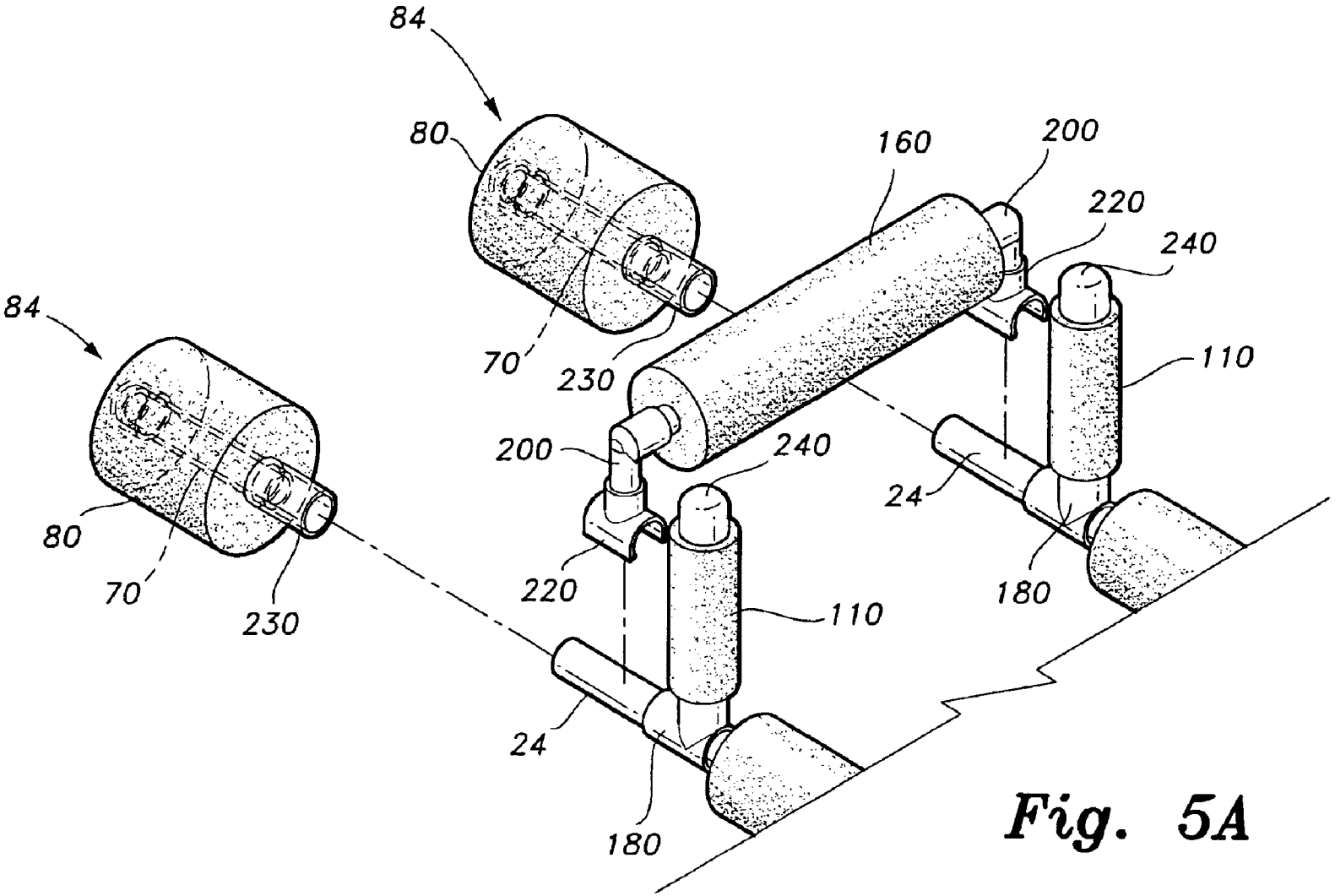
FIG. 5A is a fragmentary view from the embodiment of FIG. 2, showing the removable crossbar and showing attachment of terminal ends to the invention.
Figure 5B:
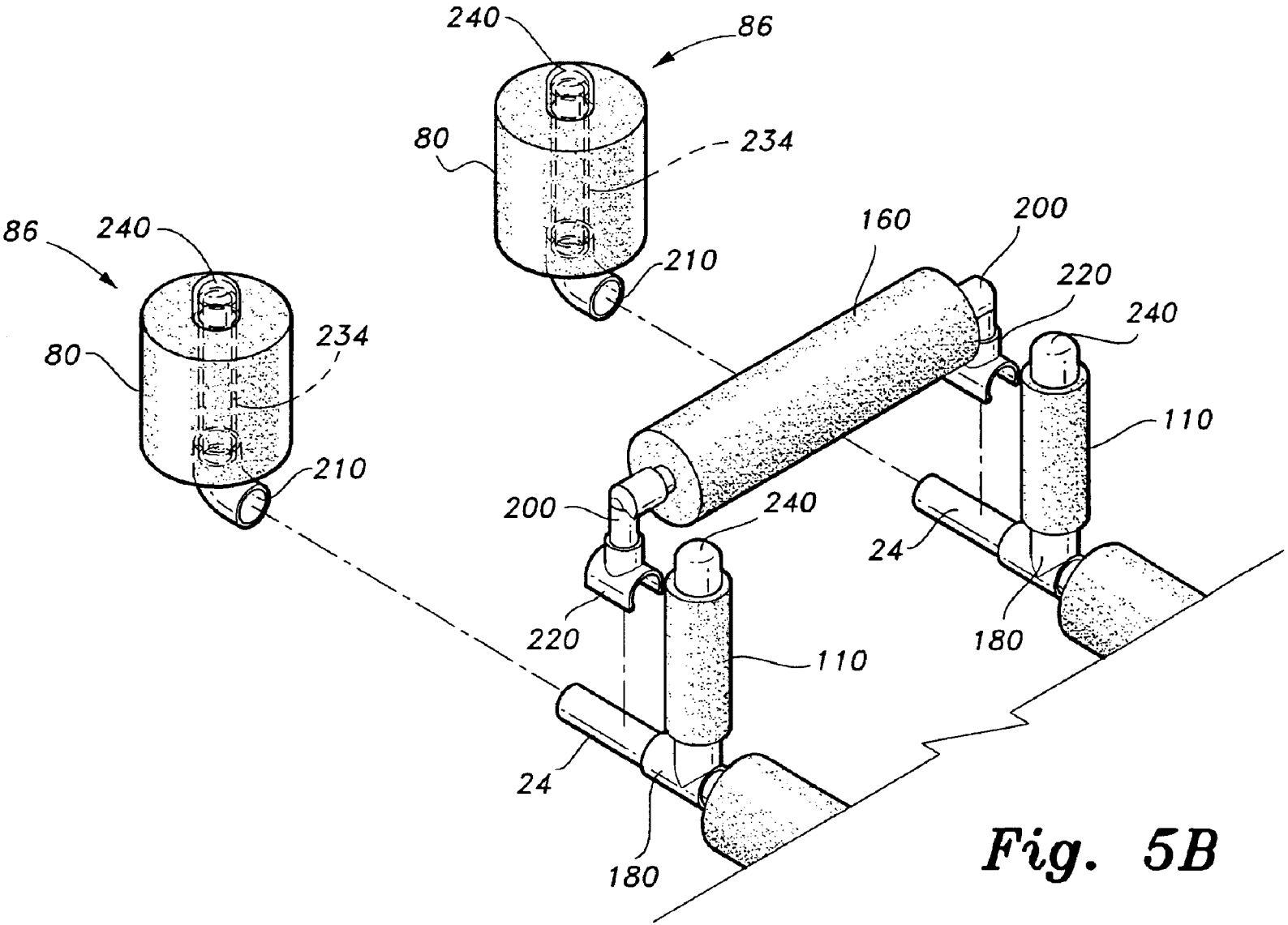
FIG. 5B is a fragmentary view of an alternative embodiment of a water walker assistant according to the present invention with vertical terminal ends.

As shown in FIGS. 5A and 5B, two different types of terminal end members, 84 and 86 respectively, may be attached to the opposing side sections S. The first type of terminal end 84, shown in FIG. 5A, is a straight hollow tubular member 230 adapted to receive a segment 24 of the opposing side sections S. The second type of terminal end 86, shown in FIG. 5B, comprises a straight hollow tubular member 234 connected to an elbow joint 210. One open end of the elbow joint receives straight hollow tubular member 234, while the second open end is adapted to receive and retain segment 24 of the opposing side section S. Each of the above-described terminal ends is fitted with a flotation member 80.

Figure 4:
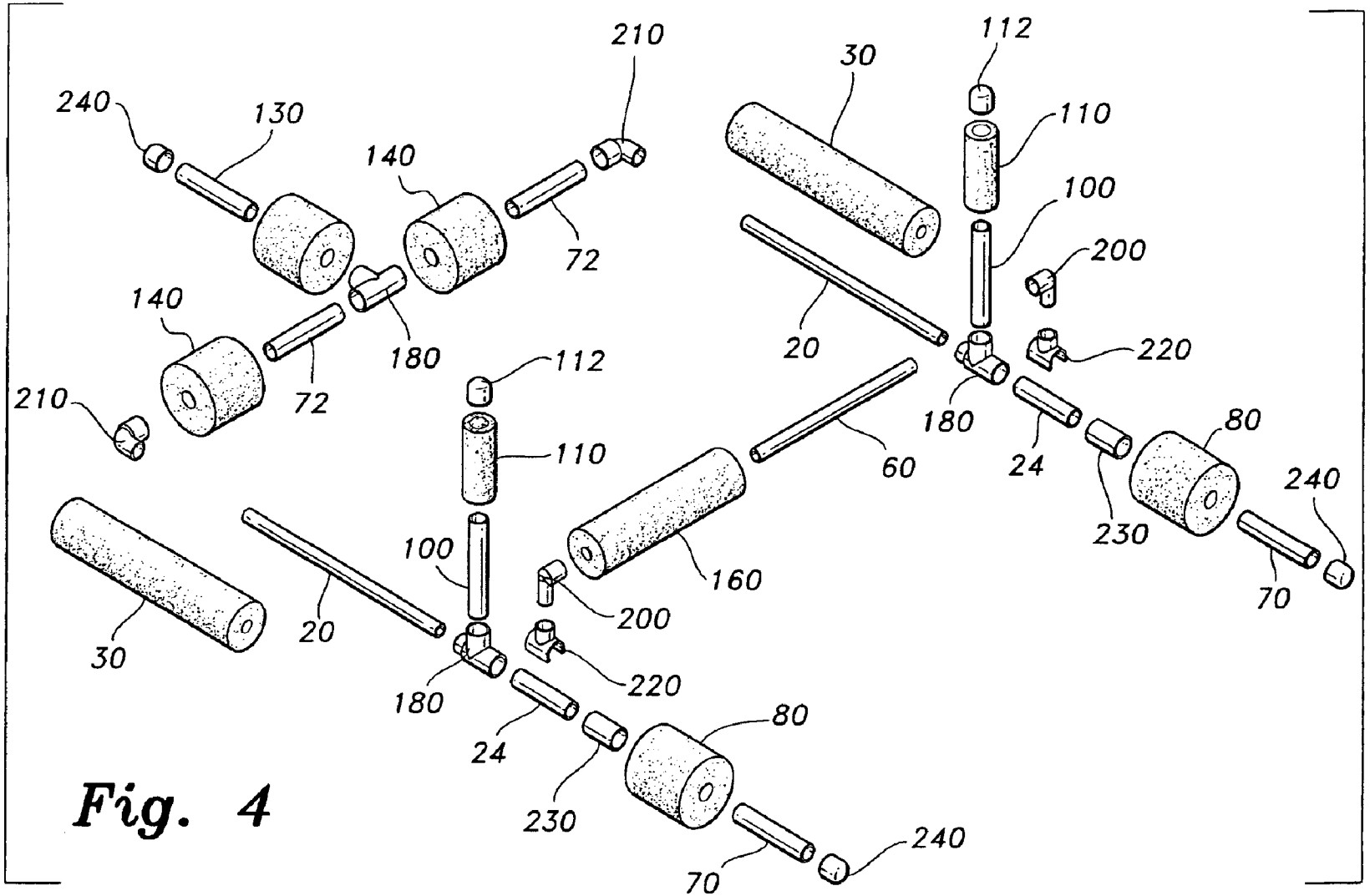
FIG. 4, is an exploded, perspective view of an embodiment of the present invention.

FIG. 4 shows an assembly diagram for one embodiment of the invention. In the embodiment shown in FIG. 4, the front, rear and side sections of the buoyant frame are made from hollow PVC tubes, joints and fittings. The side sections are formed from three straight, hollow PVC tubes: a first segment 20, an intermediate segment 24 and a terminal end segment 70. A PVC T-joint 180 and a straight joint or sleeve 230 connect the three tube segments. The first and terminal end segments are each fitted with cylindrical flotation members, 30 and 80 respectively.

PVC elbow joints 210 are used to connect the opposing side sections to the rear section. More particularly, the elbow joints 210 connect the rear section to the first segment 20 of the opposing side sections. The rear section comprises two PVC tubes 72 joined together with a PVC T-joint 180. A third PVC tube 130 extends from the central opening in the T-joint 180, perpendicular and planar to the rear section of the invention. As shown in FIG. 4, each of the three PVC tubes extending from the T-joint 180 is fitted with a cylindrical flotation member 140. In addition, a watertight cap 240 seals the end of the centrally disposed PVC tube 130.

As seen in FIG. 4, the two vertical handles 100 extending from the opposing side sections are hollow PVC tubes. The handles 100 are connected to the opposing side members through PVC T-joints 180. The handles 100 extend from the central opening in the T-joint 180, while the side openings connect the first segment 20 and intermediate segment 24 of the opposing side sections S. Hollow, cylindrical gripping material 110 is fitted around each handle 100, and a watertight cap 112 covers the top end of each handle.

FIG. 4 further depicts how the removable crossbar 60 is attached to the opposing side sections. The crossbar 60 depicted is a hollow PVC tube. Two PVC elbow fittings 200 are attached to opposite ends of the crossbar 60, and a cylindrical flotation member 160 is fitted to the crossbar. Saddle fittings 220 connect the crossbar 60 to the intermediate segment 24 of the opposing side sections.

The terminal end segments 70 of the opposing side sections shown in FIG. 4 are straight, hollow PVC tubes, fitted with cylindrical flotation members 80. The terminal ends are connected to the intermediate segment 24 of the opposing side members by way of a straight joint 230. In addition, the end of each terminal end segment is sealed with a watertight cap 240.

It is to be understood that the present invention is not limited to the embodiments described above, but encompasses any and all embodiments within the scope of the following claims.

We claim:

1. A flotation device for supporting a person in a body of water comprising:

an enclosure of general ly rectangular planar shape and having a density less than that of water, the enclosure comprising a plurality of elongated buoyant support members interconnected to define a front section, a rear section, and first and second opposite side sections, wherein the front, rear, and side sections define an internal space dimensioned and configured to surround a person;

elbow-shaped connectors, T-shaped connectors, and saddle fittings respectively disposed between the plurality of elongated buoyant support members for interconnecting said members; and a plurality of flotation members, each flotation member having a density less than that of water and a generally elongated shape, the flotation members being fitted to the front, rear, and side sections of the enclosure.

2. The flotation device of claim 1, wherein the plurality of flotation members each comprise an individual cylinder of flotation material with a hollow bore, for wrapping the cylinder around its buoyant support members.

3. The flotation device of claim 1, wherein the plurality of flotation members are each made of urethane closed cell foam.

4. The flotation device of claim 1, wherein the plurality of buoyant support members each have a hollow bore at least partly filled with urethane closed cell foam.

5. The flotation device of claim 1, wherein the plurality of buoyant support members each have a hollow bore filled with air.

6. The flotation device of claim 1, wherein the plurality of buoyant support members are hollow PVC tubes at least partly filled with urethane closed cell foam.

7. The flotation device of claim 1, wherein the plurality of buoyant support members are hollow PVC tubes filled with air.

8. The flotation device of claim 1, wherein two oppositely disposed handles extend vertically from the side sections, said handles being wrapped with hand-grips.

9. The flotation device of claim 8, wherein the front section is a removable crossbar secured to the opposing side sections, and disposed intermediate of said handles and the ends of the opposing side sections.

10. The flotation device of claim 8, wherein the front section is a stationary crossbar rigidly secured to the opposing side sections, and disposed intermediate of said handles and the ends of the opposing side sections.

11. A flotation device for supporting a person in a body of water comprising:

an enclosure of generally rectangular planar shape and having a density less than that of water, the enclosure comprising a plurality of elongated buoyant support members interconnected to define a front section, a rear section, and first and second opposite side sections, wherein the front, rear, and side sections define an internal space dimensioned and configured to surround a person;

a plurality of flotation members, each flotation member having a density less than that of water and a generally elongated shape, the flotation members being fitted to the front, rear, and side sections of the enclosure; and an elongate member extending perpendicularly from the rear section of said enclosure and generally planar to said enclosure, said elongate member fitted with a flotation member.

12. The flotation device of claim 11, wherein said elongate member is PVC tubing.

13. A flotation device for supporting a person in a body of water comprising:

an enclosure of generally rectangular planar shape and a density less than that of water, the enclosure comprising a plurality of PVC tube members interconnected to form a front section, a rear section, and first and second opposite side sections, wherein the front, rear, and side sections define an internal space adapted to surround a person;

a plurality of flotation members, each flotation member having a density less than that of water, a generally elongated shape, the flotation members fitted to the front, rear, and side sections of the enclosure; and an elongate member extending perpendicularly from the rear section of said enclosure and generally planar to said enclosure, said elongate member fitted with a flotation member.

14. The flotation device of claim 13, wherein two oppositely disposed handles extend vertically from the side sections said handles being wrapped with hand-grips.

15. The flotation device of claim 14, wherein the front section is a removable crossbar secured to the opposing side sections, and disposed intermediate of said handles and the ends of the opposing side sections.

16. The flotation device of claim 14, wherein the front section is a stationary crossbar rigidly secured to the opposing side sections, and disposed intermediate of said handles and the ends of the opposing side sections.

17. The flotation device of claim 13, wherein the plurality of flotation members are made of urethane closed cell foam.

18. The floatation device of claim 13, wherein the plurality of PVC tube members each have a hollow bore at least partly filled with urethane closed cell foam.

19. The flotation device of claim 13, wherein the plurality of PVC tube members each have a hollow bore filled with air.

* * * * *